United States Patent [19]

Fleischer

[11] 4,125,762

[45] Nov. 14, 1978

[54] ROTARY ELECTROMAGNETIC INDICATOR SYSTEM

[75] Inventor: Donald W. Fleischer, Wethersfield, Conn.

[73] Assignee: Veeder Industries Inc., Hartford, Conn.

[21] Appl. No.: 838,763

[22] Filed: Oct. 3, 1977

Related U.S. Application Data

[63] Continuation-in-part of Ser. No. 706,129, Jul. 16, 1976, Pat. No. 4,071,742.

[51] Int. Cl.[2] ..... G06M 1/28; G06M 1/10; B67D 5/22

[52] U.S. Cl. ..... 235/92 FL; 235/92 A; 235/92 EV; 235/92 EC; 235/144 ME

[58] Field of Search ..... 235/92 FL, 92 FP, 92 A, 235/92 C, 92 EV, 92 EC, 92 MP, 144 ME, 144 PN; 222/28; 340/319, 378 MW; 335/181; 310/156

[56] References Cited

U.S. PATENT DOCUMENTS 3,591,774 7/1971 Huber ..... 235/92 FP

*Primary Examiner*—Joseph M. Thesz

*Attorney, Agent, or Firm*—Prutzman, Kalb, Chilton & Alix

[57] ABSTRACT

Gasoline dispensing apparatus with cost and volume registers composed of banks of rotary electromagnetic indicators, each having an electromagnetic stator with a drive coil for indexing a respective rotary indicator wheel and a sensing coil for sensing wheel rotation and direction, and an indicator operating circuit for accumulating, and for indexing the indicator wheels for registering, the cost and volume of fuel delivered. The sensing coil is employed for monitoring and verifying wheel rotation and each indicator wheel is indexed by energizing the respective drive coil in the appropriate direction and for an optimum interval controlled by the respective sensing coil. The indicator wheels are reset in the reverse direction to their "0" count positions, where the wheels are retained against further reverse rotation by one-way locking pawls, and are then indexed in the forward direction one step and in the reverse direction one step and then through one additional drive coil energizing cycle to verify that the indicator wheels are at their "0" positions.

17 Claims, 6 Drawing Figures

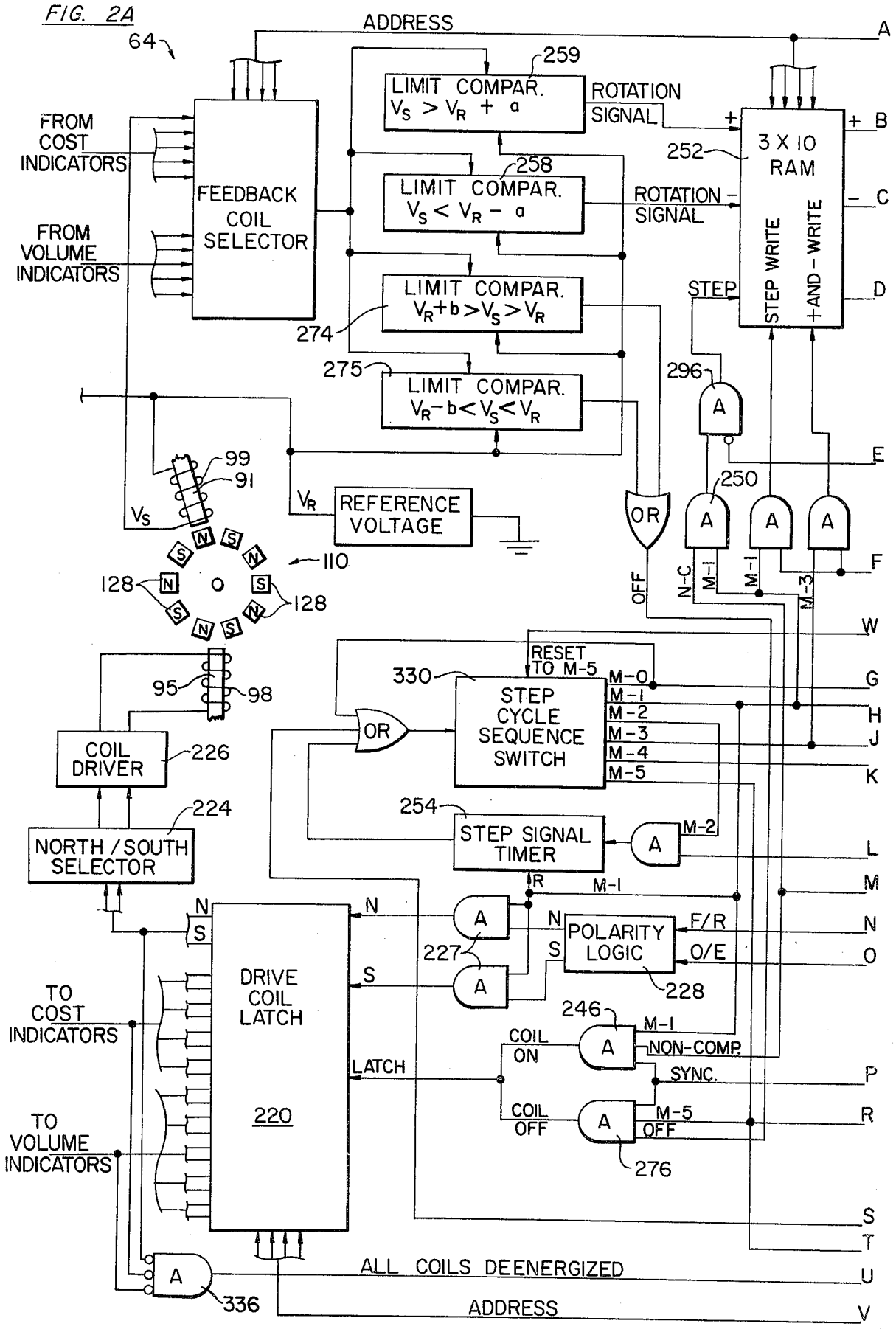
FIG. 2A
64
ADDRESS
A
FROM COST INDICATORS
FROM VOLUME INDICATORS
FEEDBACK COIL SELECTOR
259
LIMIT COMPAR. $V_S > V_R + a$
ROTATION SIGNAL
258
LIMIT COMPAR. $V_S < V_R - a$
ROTATION SIGNAL
LIMIT COMPAR. $V_R + b > V_S > V_R$
274
275
LIMIT COMPAR. $V_R - b < V_S < V_R$
252
3 X 10 RAM
STEP WRITE
+AND − WRITE
STEP
+ B
− C
D
296
E
250
F
99
91
$V_S$
$V_R$
REFERENCE VOLTAGE
OR
OFF
N-C
M-1
M-3
110
128
W
RESET TO M-5
330
STEP CYCLE SEQUENCE SWITCH
M-0
M-1
M-2
M-3
M-4
M-5
G
H
J
K
95
98
COIL DRIVER
226
224
NORTH / SOUTH SELECTOR
254
STEP SIGNAL TIMER
L
M
N
S
DRIVE COIL LATCH
220
227
POLARITY LOGIC
F/R
O/E
228
O
TO COST INDICATORS
TO VOLUME INDICATORS
LATCH
246
COIL ON
NON-COMP.
SYNC.
P
COIL OFF
M-5 OFF
R
276
336
ALL COILS DEENERGIZED
U
ADDRESS
V A
AA
ODD/EVEN
BB
ROTATION DIRECTION LOGIC
ADD
SUB.
262
B
C
TO PUMP MOTOR
A
270
FF
R
272
MANUAL RESET
FF
40
CC
S
DD
EE
FF
GG
HH
JJ
KK
LL
MM
NN
VV
ERROR DETECT LOGIC
266
STEP
D
F/R
A
ERROR
306
ERROR INDICATOR
268
OR
239
FORWARD/REVERSE
E
"0" REV. CHK.
M-0
RESET
F
M-4
SYNC.
W
ODD/EVEN
OR
ODD
SYNC.
M-4
G
N-C
H
J
K
OR
M-1
L
M
N
O
327
332
334
OO
M-3,4
326
PP
RR
P
335
R
M-5
324
OSC
325
328
÷2
S
SS
T
M-5
U
SYNC.
329
TT
V
UU

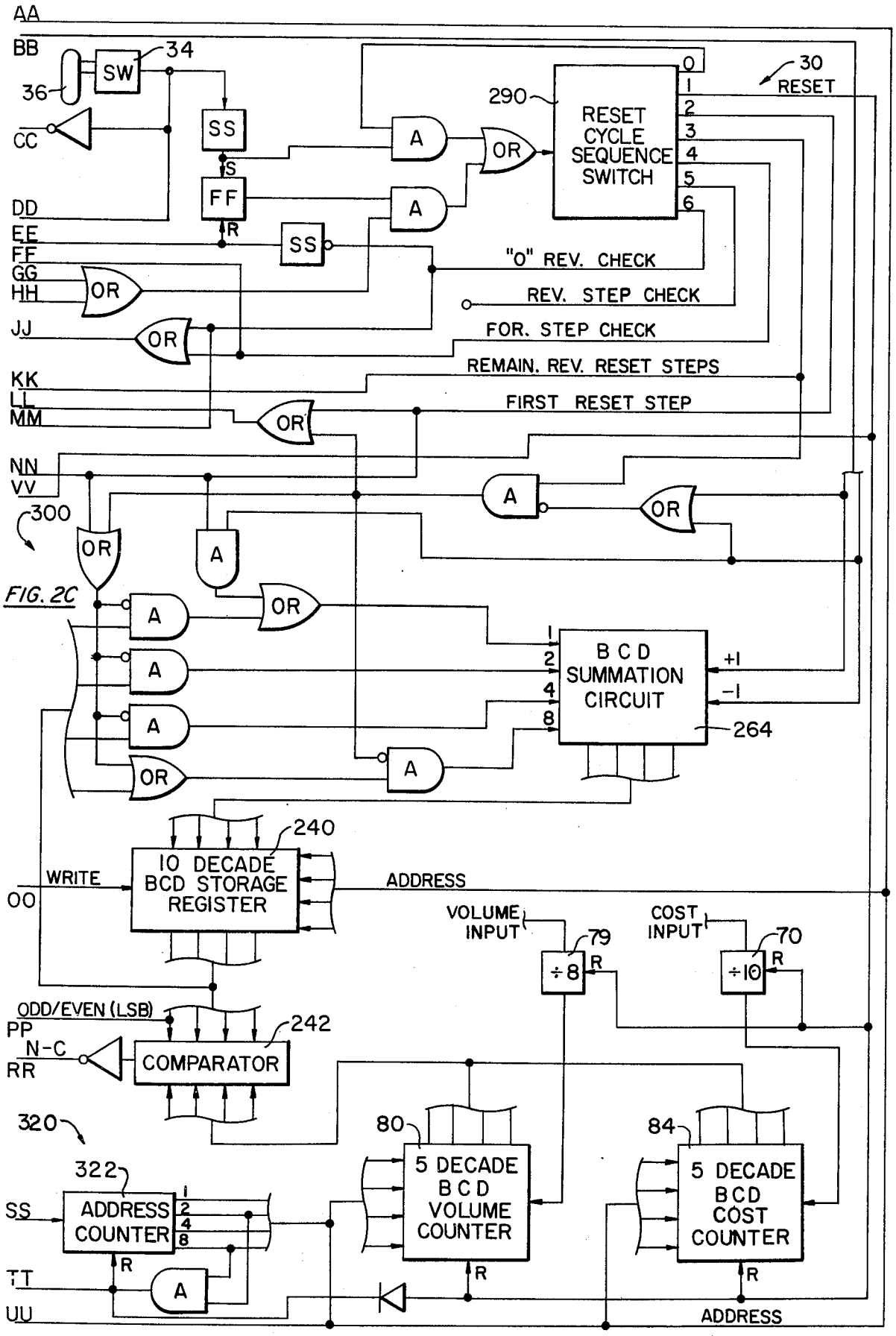
AA
BB
SW
34
36
CC
DD
EE
FF
GG
HH
JJ
KK
LL
MM
NN
VV
SS
FF
S
R
A
OR
290
RESET CYCLE SEQUENCE SWITCH
30
RESET
"0" REV. CHECK
REV. STEP CHECK
FOR. STEP CHECK
REMAIN. REV. RESET STEPS
FIRST RESET STEP
300
FIG. 2C
B C D SUMMATION CIRCUIT
+1
-1
264
240
10 DECADE BCD STORAGE REGISTER
WRITE
OO
ADDRESS
VOLUME INPUT
COST INPUT
79
70
÷8
÷10
ODD/EVEN (LSB)
PP
N-C
RR
242
COMPARATOR
320
322
ADDRESS COUNTER
TT
UU
80
5 DECADE BCD VOLUME COUNTER
84
5 DECADE BCD COST COUNTER
ADDRESS

ROTARY ELECTROMAGNETIC INDICATOR SYSTEM

RELATED APPLICATION

This is a continuation-in-part of my pending application Ser. No. 706,129, filed July 16, 1976, and entitled "Rotary Electromagnetic Indicator System", now U.S. Pat. No. 4,071,742.

SUMMARY OF THE INVENTION

The present invention relates generally to rotary electromagnetic indicator systems of the type disclosed in the copending application Ser. No. 706,129, filed July 16, 1976 of D. W. Fleischer and entitled "Rotary Electromagnetic Indicator System", now U.S. Pat. No. 4,071,742 and more particularly to a new and improved indicator system having notable utility in fuel dispensing apparatus for registering the volume and/or cost amount of fuel delivered.

It is a primary aim of the present invention to provide a new and improved rotary electromagnetic indicator system for fuel dispensing apparatus providing improved operation and reliability in the registration of the volume and/or cost amount of fuel delivered.

It is a further aim of the present invention to provide a new and improved relatively low cost and high speed rotary electromagnetic decade indicator.

It is another aim of the present invention to provide in a counting and indicating system of the type employing one or more rotary indicator wheels, a new and improved electromagnetic indexing system operable for electromagnetically indexing each indicator wheel.

It is another aim of the present invention to provide in a counting and indicating system of the type having an electronic storage register for storing a count and one or more rotary indicators for displaying the stored count, a new and improved indexing system for indexing each rotary indicator for registering the corresponding stored digit count of the electronic storage register.

It is another aim of the present invention to provide in a rotary electromagnetic indicator system of the type described, a new and improved indicator rotation monitoring systme for verifying that the indicator is correctly indexed and for signalling incorrect indicator operation.

It is a further aim of the present invention to provide a new and improved rotary electromagnetic indicator system having uniform and reliable operation over a wide range of operating temperature and voltage and which requires less average power for operation.

It is a further aim of the present invention to provide a new and improved reset system for a rotary electromagnetic decade indicator for resetting the decade indicator to "0" or other predetermined reset position.

It is a further aim of the present invention to provide a new and improved rotary electromagnetic indicator having a permanent magnet indicating rotor and a stator with a stator core with an annular arrangement of a plurality of salient poles, a drive coil adapted to be selectively energized for magnetically indexing the rotary indicator and a sensing coil for monitoring and verifying indicator rotation and for timely de-energizing the drive coil.

It is another aim of the present invention to provide a new and improved rotary electromagnetic indicator system operable at a relatively high effective indexing rate.

It is another aim of the present invention to provide in a rotary electromagnetic indicator, a new and improved metod of operation for accurately indexing an indicator wheel from one indicating position to a succeeding indicating position and for reducing or eliminating wheel overshoot and/or undershoot as the wheel is indexed.

It is a further aim of the present invention to provide a new and improved rotary electromagnetic counting system for indexing a rotary counter wheel.

It is another aim of the present invention to provide a new and improved single wheel rotary indicator module usable along or in a bank thereof as a numeral display or the like.

Other objects will be in part obvious and in part pointed out more in detail hereinafter.

A better understanding of the invention will be obtained from the following detailed description and the accompanying drawings of an illustrative application of the invention.

BRIEF DESCRIPTION OF THE DRAWINGS

In the drawings:

FIGS. 2A through 2C collectively provide a combined diagrammatic illustration and functional schematic, partly broken away, showing an indicator operating circuit of the indicator system;

DESCRIPTION OF THE PREFERRED EMBODIMENTS

Figure 1:
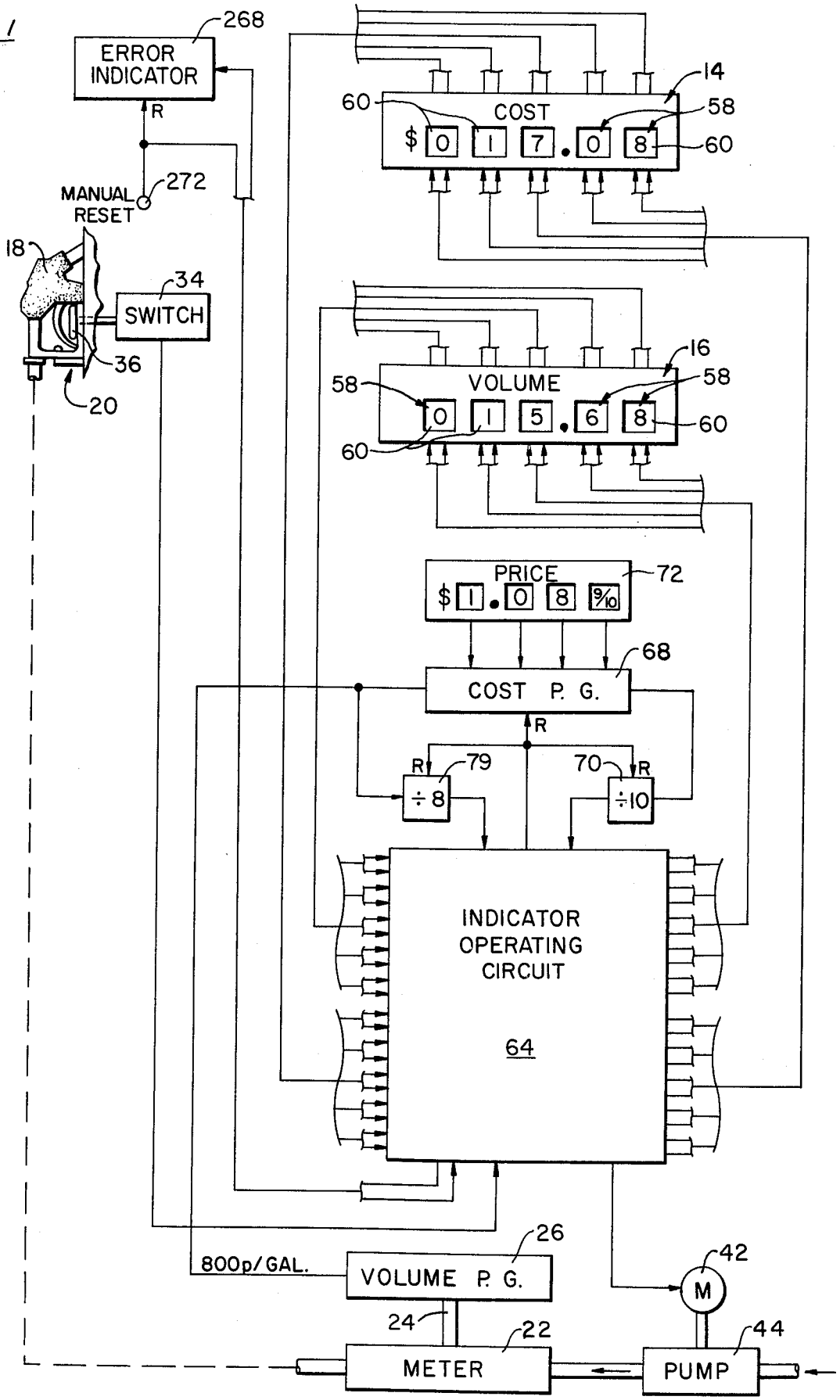
FIG. 1 is a combined diagrammatic illustration and functional schematic, partly broken away, of gasoline dispensing apparatus incorporating an embodiment of a rotary electromagnetic indicator system of the present invention.

Referring now to the drawings in detail wherein like reference numerals indicate like parts throughout the several figures, a gasoline dispensing pump 10 employing cost and volume registers 14, 16 respectively incorporating the present invention, is shown having a nozzle 18 for delivering fuel and a suitable nozzle storage receptacle 20 for storing the nozzle 18 between fuel deliveries. In a conventional manner, a meter 22 mounted in a fuel conduit leading to the nozzle 18 has a rotary output shaft 24 driven in accordance with the volume amount of fuel delivered. The meter shaft 24 is connected to drive a suitable pulse generator 26 for generating a train of electrical volume pulses with a pulse for each predetermined volume increment of fuel dispensed, in the shown embodiment for generating 800 pulses for each gallon unit volume on which the fuel unit volume price is based. For example, the pulse generator 26 may be a rotary pulse generator of the type described in U.S. Pat. No. 3,786,272 of John G. Gamble et al dated Jan. 15, 1974 and entitled "Hall Effect Rotary Pulse Generator".

For the purpose of understanding the manner of operation of the rotary electromagnetic indicator system of the present invention, a functional schematic of an indicator operating circuit is shown and described hereinafter and the operating circuit is preferably provided primarily by a suitable microprocessor.

Figure 2B:
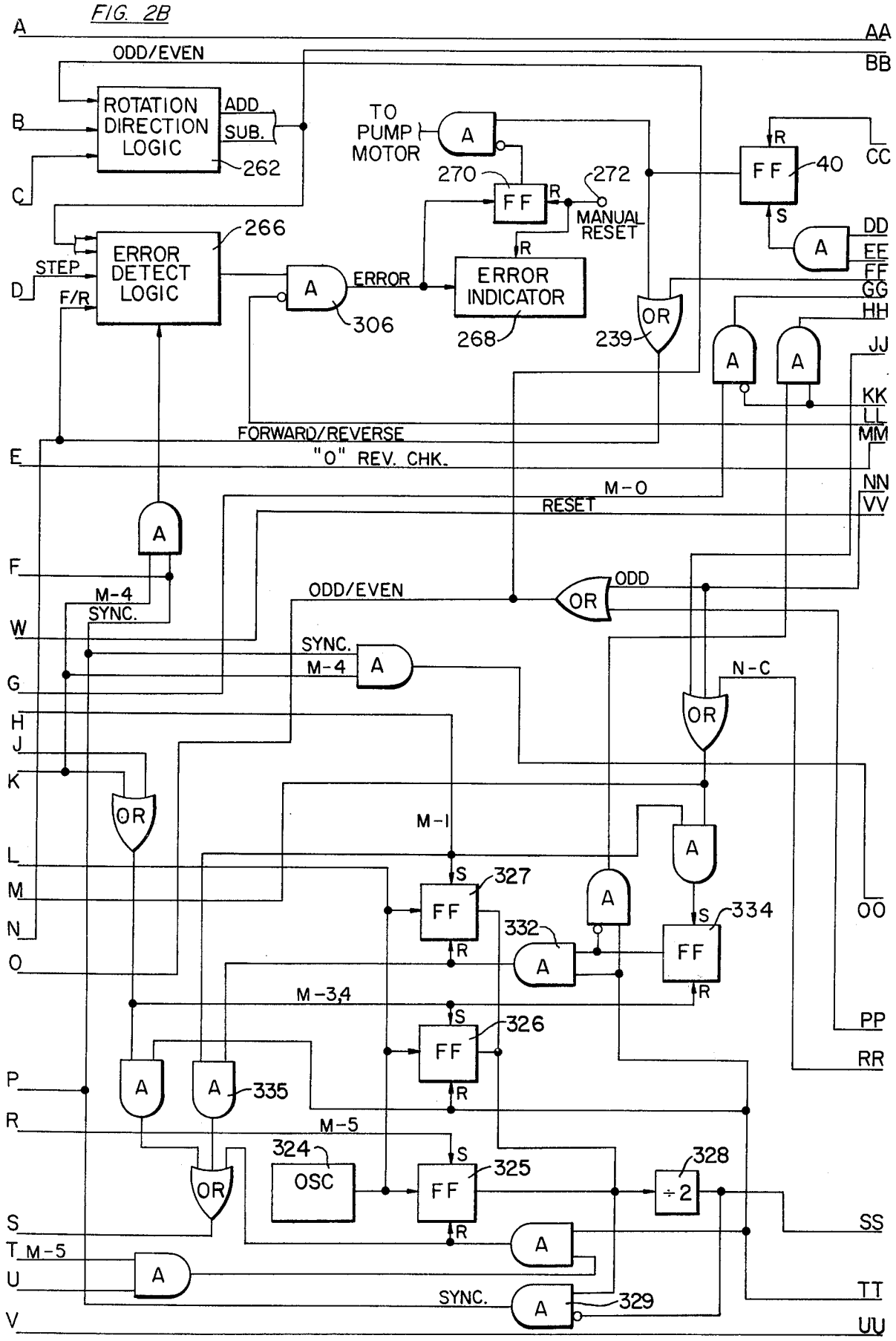

A register reset circuit 30 (hereinafter described) is selectively operated by a control switch 34 actuated by a handle 36 for resetting the cost and volume registers 14, 16 just prior to the commencement of each fuel delivery. The register control handle 36 is positioned adjacent the nozzle storage receptacle 20 and such that the handle 36 has to be rotated to its vertical or "off" position to open the control switch 34 to permit the nozzle 18 to be placed in its storage receptacle at the completion of a fuel delivery, and the nozzle 18 has to be removed from its storage receptacle 20 to permit the handle 36 to be rotated to its horizontal or "on" position to close the switch 34. Rotation of the handle 36 to its vertical or "off" position provides for resetting a motor control latch 40 (FIG. 2B) to de-energize a drive motor 42 for a delivery pump 44, and rotation of the handle 36 to its horizontal or "on" position provides for operating the reset circuit 30 for resetting the cost and volume registers 14, 16 to zero and then set the motor control latch 40 for re-energizing the motor 42 and thereby condition the dispensing system for delivering fuel.

Each register 14, 16 comprises a bank of five rotary indicators or decade modules 58 of increasing order of significance with corresponding number wheels 60. An indicator operating circuit 64 (hereinafter described) is operable for accumulating counts of the volume and cost amounts of fuel dispensed and for indexing the bank of volume indicators 58 for registering the accumulated volume count and for indexing the bank of cost indicators 58 for registering the accumulated cost count. Also, as hereinafter described, the reset circuit 30 of the indicator operating circuit 64 provides for resetting the volume and cost indicator wheels 60 to "0" when the handle 36 is turned to its horizontal or "on" position and just prior to the commencement of a fuel delivery.

The indicator operating circuit 64 comprises an addressable BCD volume counter 80 having five separte BCD storage decades of ascending order of significance for the five volume indicators 58 respectively. The volume pulse generator 26 is connected via a divide-by-eigth input counter section 79 to the BCD volume counter 80 so that the BCD volume counter 80 accumulates the volume of fuel dispensed to two decimal places. The addressable BCD volume counter 80 and input counter section 79 are connected to the reset circuit 30 to be reset between fluid deliveries. During the following delivery of fuel, the BCD volume counter 80 is indexed to accumulate the volume amount of fuel delivered, it being seen that the input counter section 79 produces a count or transfer pulse for indexing the volume counter 80 for each eight pulses from the pulse generator 26 and therefore for each one hundredth of a gallon of fuel dispensed. The pulse generator 26 is not reset in the described embodiment when the registers 14, 16 are reset (although, if desired, suitable additional means could be provided for resetting the pulse generator 26), and therefore the input counter section 79 is preferably reset to a four count condition and such that each hundredth gallon pulse transmitted to the BCD volume counter 80 is timed to occur at approximately midway during the delivery of the respective hundredth gallon increment of fuel.

A suitable cost pulse generator 68 and a divide-by-ten input counter section 70 are provided for transmitting a train of one cent or hundredth cost pulses to a five decade BCD cost counter 84 like the volume counter 80. The cost pulse generator 68 is connected to a suitable price selector 72 and to the volume pulse generator 26 to generate an appropriate train of thousandths pulses (each representing $0.001) for each volume pulse and so that the addressable BCD cost counter 84 accurately accumulates the cost of fuel delivered to the nearest cent. The input cost counter section 70 is preferably reset to a five count when the cost accumulator is reset and such that each hundredth or one cent cost pulse transmitted to the BCD cost counter 84 occurs approximately midway during the delivery of the respective hundredth or one cent cost increment of fuel.

Figure 4:
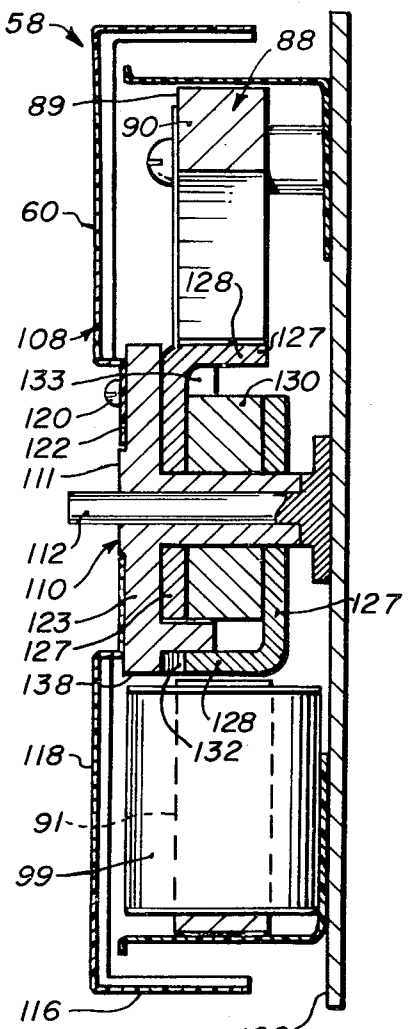
FIG. 4 is an enlarged front elevation section view, partly broken away and partly in section, of the indicator module.
Figure 3:
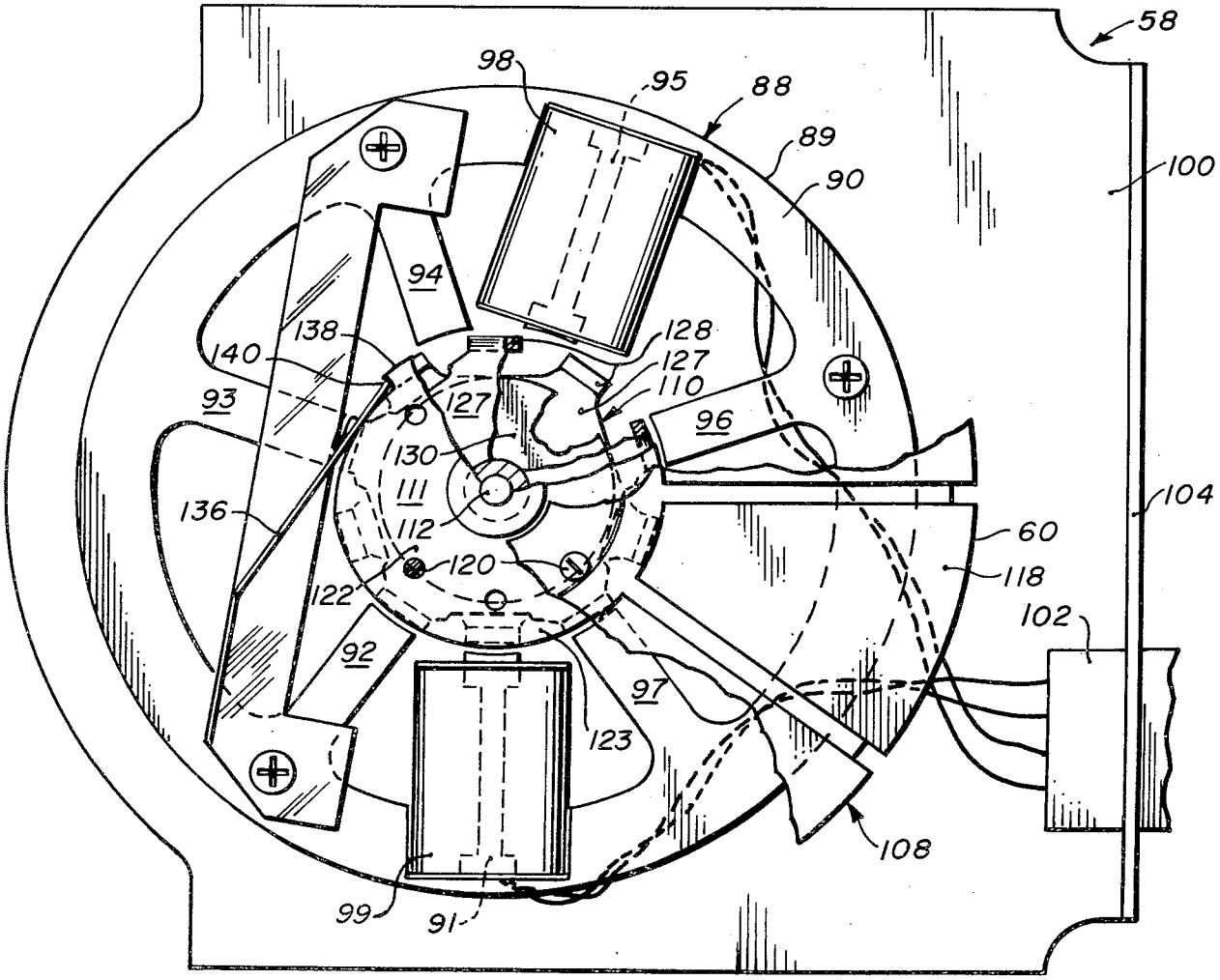
FIG. 3 is an enlarged elevation side view, partly broken away and partly in section, of a rotary indicator module of the indicator system.

Referring to FIGS. 3 and 4, each rotary number wheel 60 is adapted to be selectively electromagnetically stepped to each of its ten "0" through "9" equiangularly spaced count positions in sequence. For that purpose, the rotary decade module 58 comprises a stator 88 having a generally flat stator core 89 with an outer circular ring 90 and seven angularly spaced radially inwardly extending salient poles 91–97, a "primary" or drive salient pole winding or coil 98 on the salient pole 95 and a feedback or pickup salient pole winding or coil 99 on the salient pole 91. The stator core 89 (which, for example, may be made of flat soft iron laminations) is mounted on a frame 100, and a suitable electrical connector 102 mounted on a rear flange 104 of the frame 100 is provided for electrical connection to the four leads of the two stator coils 98, 99.

The rotary decade module 58 has a rotor 108 with a central permanent magnet hub assembly 110 with a plastic support hub 111 rotatably mounted on a stub shaft 112 secured to the frame 100. The number wheel 60 of the rotor 108 is formed of thin plastic with an outer b 0–9 numeral bearing rim 116 encircling the stator ring 90 and an intermediate web 118 secured by fasteners 120 to an outer end face 122 of a generally circular end flange 123 of the support hub 111.

A pair of identical axially spaced and oppositely facing coaxial pole pieces 127 are mounted on the plastic support hub 111. Each of the pole pieces 127 has five equiangularly spaced (i.e., 72° spaced) axially extending segments or poles 128, each having an 18° wide pole face, and the two pole pieces 127 are mounted on the support hub 111 to provide an annular arrangement of 10 equiangularly spaced poles 128. A circular axially magnetized permanent magnet 130 is mounted coaxially between and in engagement with the pole pieces 127 so that the five poles 128 of each pole piece 127 have the same polarity and the 10 poles of the annular pole arrangement have alternating polarity. The support hub 111 is molded with 10 equiangularly spaced slots 132, 133 in the end flange 123 for receiving and thereby angularly retaining the poles 128 of the two pole pieces 127 respectively. The inner pole piece 127 is press fit onto the plastic support hub 111, and the circular permanent magnet 130 and outer pole piece 127 are axially retained in assembled condition by the magnetic attraction of the intermediate permanent magnet 130 and oppositely facing pole pieces 127.

The number wheel 60 is electromagnetically indexed in the forward or additive direction, in the clockwise direction as viewed in FIG. 3, by the selective and timed energization of the drive coil 98 to index the number wheel 60 in stepwise fashion in the manner of a digital counter wheel. A one-way locking pawl 136 provided in the form of a light leaf spring is mounted on the stator core ring 90 for engagement with a peripheral cam edge 138 on the end flange 123 of the support hub 111. The cam edge 138 has a single shoulder or stop 140 engageable by the pawl 136 when the wheel 60 is rotated in the reverse or subtracting angular direction slightly beyond its "0" count position, (e.g., about one-fourth of a count or 9° beyond its "0" count position) toward its "9" count position.

In each of the ten equiangularly spaced count positions of the wheel 60, one of the ten rotor poles 128 of one polarity is radially aligned with the pickup coil stator pole 91, and four other rotor poles 128 of opposite polarity (i.e., on the other pole piece 127) are radially aligned with the stator poles 92, 93, 96 and 97 having a 72° spacing and symmetrically arranged relative to the stator pole 91. The five salient poles 91–93, 96 and 97 therefore provide a "secondary" magnetic circuit for magnetically sensing rotation of the rotor. Also, the five stator poles 91–93, 96 and 97 provide an effective and preferred magnetic detent for holding the number wheel 60 at each full count position without either coil 98, 99 being energized.

The remaining two salient poles 94, 95 of the stator are angularly positioned 36° apart and preferably approximately one-half count or 18° out of phase with and generally diametrically opposed to the stator poles of the "secondary" magnetic circuit and form with the drive coil 98 mounted on the stator pole 95, a "primary" magnetic circuit for indexing the rotor in either angular direction from a prior full count position to a succeeding full count position.

Each wheel indexing cycle is effected by energizing the drive coil 98 (in the appropriate direction corresponding to the desired direction of rotation and the existing wheel position) for a full time-controlled indexing cycle having an initial time phase providing for accelerating the number wheel 60 from the prior full count position to a position approximately midway the prior and succeeding full count positions where the rotor poles are aligned with the salient poles of the "primary" magnetic circuit of the stator. The drive coil 98 is maintained energized for approximately an equal but shorter final time phase providing for opposing the continuing rotation of the rotor in the desired direction and for thereby decelerating the rotor to a stop at approximately its succeeding count position, whereupon the drive coil 98 is de-energized. The pickup coil 99 is employed as an essentially passive coil for sensing the direction and angular velocity of the magnetic field of the rotor permanent magnet 110 and therefore the direction and angular velocity of the number wheel 60. Accordingly, the pickup coil 99 preferably has a larger number of turns than the drive coil 98 for effectively sensing the wheel rotation. When zero or approximately zero rotor velocity is sensed as hereinafter described, the "primary" or drive coil 98 is de-energized to terminate the wheel indexing cycle with the wheel held correctly located at its succeeding count position by the "secondary" magnetic circuit.

Because of wheel friction, the rate of wheel deceleration will be greater than the rate of wheel acceleration. The final or deceleration time phase is therefore shorter than the initial or acceleration time phase. Also, the "primary" magnetic circuit may be slightly angularly offset in the forward or additive direction from the one-half count position of the counter wheel so that wheel rotation during the first phase is greater than wheel rotation during the last phase and the wheel is decelerated to a stop at exactly the next full count position. In that event, reverse rotation of the number wheel 60 (when the wheel is being reset) would be effected at a lower but acceptable rate.

Thus, the number wheel 60 is indexed one count by establishing the operating polarity of the salient pole 95, with the respective drive coil 98, in accordance with the desired direction of rotation and the polarity of the adjacent rotor poles 128 and therefore the existing count position of the number wheel. Thus, for example, the drive coil 98 is energized to establish a North operating polarity for indexing the rotor in the additive or forward direction from an odd to an even count and a South operating polarity for indexing the rotor in the additive direction from an even to an odd count. For indexing the number wheel in the reverse or subtractive direction, the coil is energized to establish the reverse operating polarity (i.e., South polarity for indexing the number wheel in the reverse direction from an odd to an even count position and North polarity for indexing the number wheel in the reverse direction from an even to an odd count position). Similarly, the passive or feedback coil generates for example a plus (+) relative voltage when the number wheel rotates from an odd to an even number position in the additive or forward angular direction and a minus (−) relative voltage when the number wheel rotates from an even to an odd number position in the additive or forward angular direction and the reverse voltage polarity in the reverse direction of rotation.

In the embodiment of FIGS. 1 and 2, the rotary decade modules 58 are preferably indentically operated and therefore, for simplicity of illustration only a single decade module 58 is schematically shown in FIG. 2.

The indicator operating circuit 64 employs a multiplexing system 320 having an address counter 322 for addressing the BCD decades of the volume and cost counters 80, 84 in succession and for addressing other components of the indicator operating circuit 64 in synchronism therewith for controlling the energization of the respective indicator drive coils 98. The multiplexing system 320 is adapted to be stepped by alternate clock pulses from a suitable oscillator or clock 341 via one of three control latches 325, 326, or 327 and a divide-by-two counter 328. Also, a gate 329 is provided for generating a strobe or "sync" pulse at alternate clock pulses for timely strobing certain components of the indicator operating circuit 64. The control latch 327 is connected to be set by the first step or M-1 mode output of an indicator step cycle sequence switch 330 to index the address counter 322 through one or more ten step address cycles. The control latch 327 is reset via a timing gate 332 at the completion of any 10-step address cycle during which a "non-compare" (N-C) signal is applied to set a latch 334. Simultaneously, the indicator step cycle sequence switch 330 is stepped via an AND gate 335 to its succeeding M-2 mode or step.

The control latch 326 is connected to be set by the third and fourth steps or M-3 and M-4 mode outputs of the indicator step cycle sequence switch 330. For each of the third and fourth modes, the address counter 322 is indexed through a single ten-step address cycle and the control latch 326 is reset and the sequence switch 330 is stepped at the completion of the address cycle.

Similarly, the control latch 325 is connected to be set by the M-5 mode output of the sequence switch 330 to provide for stepping the address counter 322 through successive address cycles until the control latch 325 is reset via a drive coil sensing gate 336 when all of the indicator drive coils 98 are de-energized.

The indicator operating circuit 64 comprises an addressable drive coil latch 220 (having North and South storage bits for each of the 10 volume and cost indicators 58) for controlling the operation of each drive coil 98 in each direction. A two-lead binary output of the latch 220 for each indicator 58 is connected via a suitable North/South selector 224 and a coil driver 226 to energize the respective drive coil 98 in accordance with the data stored in the latch 220. A two-lead binary input to the latch 220 is connected via timing gates 227 to a suitable polarity logic circuit 228 so that the two-lead latch input is energized (during the M-1 mode of the sequence switch 330) to reflect the forward/reverse mode of operation of the indicator operating circuit 64 and the existing odd/even number position of each indicator 58 during its address time.

During the delivery of fuel, the indicator operating circuit 64 is operated via an OR gate 239 in the "forward" mode for indexing each indicator wheel in the forward or additive counting direction. The indicator operating circuit is operated in the reverse mode during most of the reset cycle (hereinafter described) for indexing all of the rotary indicators together in the reverse angular direction to "0".

The frequency of the oscillator or clock 324 is established to provide an address cycle rate substantially greater than the start/stop counting rate of the number wheel 60 (which depends on the design of the indicator 58 and the voltage used to operate the drive coils 98) and so that the sequence switch 330 is adapted to be stepped through a sequence cycle from its M-1 mode to its M-5 mode prior to the completion of each start/stop count.

An addressable ten decade BCD storage register 240 is connected for registering the existing number positions of the five volume and five cost indicators repectively. As hereinafter described, each BCD decade of the register 240 is indexed in the additive or subtractive direction in synchronism with the respective indicator 58, for maintaining a current registration of each indicator position. Also, the register 240 is addressed in synchronism with the volume and cost counters 80, 84, and a comparator 242 is connected to generate a "non-compare" signal during any decade time the count of the BCD decade of the storage register 240 does not agree with the count of the corresponding decade of the volume or cost counter 80, 84.

During the delivery of fuel, the indicator step cycle sequence switch 330 is stepped through a complete indexing cycle for automatically indexing each number wheel 60 which does not display the count of the corresponding volume or cost counter decade (i.e., when the BCD counts of the corresponding decades of the slave register 240 and volume or cost counter 80, 84 are not the same and a "non-compare" signal is generated by the comparator 242). More particularly, during the M-1 mode of the sequence switch 330, each decade "non-compare" signal is effective via a drive coil energize control gate 246 in writing or latching the appropriate North or South coil energization data (provided by the polarity logic circuit 228) in the drive coil latch 220. The corresponding indicator drive coil 98 is thereupon energized via the respective selector 224 and driver 226 to commence a one step count. Also, each decade "non-compare" signal is simultaneously effective via an AND gate 250 in writing in a RAM 252 a "step" or count signal for the respective decade indicator.

The indexing cycle sequence switch 330 is indexed to its M-2 mode at the end of any mode 1 address cycle during which at least one decade "non-compare" signal is generated (and therefore during which at least one of the indicator drive coils 98 is energized). A step signal delay timer 254 is thereupon energized to provide a predetermined time interval delay before the sequence switch 330 is indexed to its M-3 mode. The predetermined time interval is established to be approximately equal to the average time interval (in the operating environment of the system and during the useful life of the indicators) for a number wheel 60 to be accelerated by its respective drive coil 98 to substantially its maximum angular velocity (where one of the permanent magnetic poles 128 of the rotor is magnetically aligned with the salient pole 95 of the drive coil 98). Accordingly, after the predetermined delay, the pickup or feedback coil 99 of each energized indicator would generate the maximum voltage indicating wheel rotation.

Therefore, during the M-3 mode address cycle, the voltage generated by each indicator feedback coil 99 is measured via suitable high voltage limit comparators 258, 259 to determine if the generated voltage $V_s$ has a predetermined relatively high voltage differential *a* above or below a suitable reference voltage $V_R$ and to thereby determine (a) that the indicator wheel velocity has reached a predetermined level ensuring that a step or count is in progress and (b) the direction of the indicator wheel rotation. Any resulting plus (+) or minus (−) rotation signal is stored in a respective section of the RAM 252 during the M-3 mode address cycle.

During the M-4 mode address cycle, each rotation signal stored in the RAM 252 is converted via a rotation direction logic circuit 262 (having plus (+) and minus (−) inputs from the RAM 252 and an odd/even input from the least significant bit of the slave storage register 240) to an "add" or "subtract" output signal. The "add" or "subtract" output signal is employed as +1 or −1 signal and added via a suitable BCD summation circuit 264 to the existing BCD count of the respective register decade and entered into the slave storage register 240 to update the respective storage register decade to include the respective indicator wheel step in progress. Also during the M-4 mode address cycle, a suitable error detect logic circuit 266 is strobed during each digit time to determine, from the inputs provided, if (a) each intended step or count is effected, (b) each such step is effected in the correct direction of rotation, and (c) any additional extraneous or unintended steps or counts have occurred or been caused. If any of the three possible types of errors occurs during any digit time, an error signal is generated by the error detect logic circuit 266 to operate a suitable error indicator 268 and to set a latch 270 to deactivate the fuel pump. Subsequently, the fuel pump can be reactivated and the error indicator 268 can be reset by depressing a manual reset button 272.

During the succeeding M-5 mode of the indicator sequence switch 330, the address counter 322 is repeatedly indexed via the control gate 325 through 10-step address cycles to sense when each indicator wheel being indexed is decelerated to approximately a stop by its respective drive coil 98, at which point the drive coil 98 is de-energized. For that purpose, a pair of low voltage limit comparators 274, 275 are provided for determining when the generated feedback coil voltage $V_s$ is within a predetermined narrow voltage range having a relatively low voltage *b* above or below the reference voltage $V_R$ (thereby indicating that the number wheel has been decelerated by its respective drive coil 98 to practically a stop). In that event, a "stop" or "off" signal is generated by one of the comparators 274, 275 for operating the drive coil latch 220 via a control gate 276 to de-energize the respective drive coil 98 (it being seen that the "N" and "S" energization inputs to the drive coil latch 220 are de-energized during the M-5 mode of the sequence switch 330).

When all of the drive coils 98 are de-energized, a signal is generated via a suitable AND gate 336 to reset the control gate 325 and index the sequence switch 330 to its M-0 mode. The sequence switch 330 is thereupon indexed to initiate a new comparison cycle for comparing the stored counts of the BCD decades of the slave register 240 with the respective decades of the volume and cost counters 80, 84.

Thus, it can be seen that the slave register 240 is indexed to store the volume count displayed by the volume register 16 and the cost count displayed by the cost register 14. Also, it can be seen that each time the volume counter 80 and/or cost counter 84 is indexed, the sequence switch 330 is indexed through a complete indexing cycle to provide for indexing the volume and cost indicators to display the accumulated cost counts. If the cost and/or volume counters 80, 84 are indexed at a rate greater than the indicator stepping rate, the index cycle sequence switch 330 will continue to index the volume and cost indicators 58 at the maximum available rate until the volume and cost indicators display the accumulated counts of the volume and cost counters 80, 84.

Just prior to the commencement of a fuel delivery when the control handle 36 is turned to its "on" or horizontal position, the indicator system 64 and the cost pulse generator 68 are reset to condition the system for properly registering and indicating the succeeding fuel delivery. For that purpose when the handle 36 is turned to its "on" position, a reset cycle sequence switch 290 is indexed to reset the volume and cost counters 80, 84 to zero and to reset the index cycle sequence switch 330 to its M-5 mode (for de-energizing any drive coils 98 which are still energized if the handle 36 is turned "off" and then immediately turned "on" again). The reset cycle sequence switch is then indexed by the following M-0 signal to provide a first reset step cycle during which a "non-compare" signal is applied for energizing all of the indicator drive coils 98. Also, an "odd" signal is applied to the polarity logic circuit 228 and rotation direction logic circuit 262 and a "reverse signal" is applied for signalling reverse indicator rotation. Therefore, in effect, all of the number indicator wheels 60 are assumed to be at an existing odd number position and are indexed in the reverse or subtractive direction to the next lower even number position. It is further initially assumed that each number wheel 60 is at a "9" odd number position requiring a maximum number of nine steps for indexing the indicator wheel in the reverse direction to its "0" position.

During the first reset step cycle, the indicator step cycle sequence switch 330 is cycled once to step each indicator one count. During that indicator stepping cycle, the rotation direction logic circuit 262 signals the direction each indicator wheel is indexed (in the reverse or subtractive direction if the wheel 60 had been at an odd number position and in the forward direction if the wheel 60 had been at an even number position). If a "subtract" or "−1" signal is generated, the "assumed 9" existing BCD count of the corresponding BCD decade of the register 240 is applied to the BCD summation circuit 264 via the control gate circuit 300 and an updated "8" BCD count is then written into the respective slave storage register decade of the storage register 240. If an "add" or "+1" signal is generated, indicating that the indicator wheel 60 had been at an even number position, an "assumed 8" existing BCD count is applied to the summation circuit 264 via the control gate circuit 300 and an updated "9" BCD count is then written into the respective slave storage register decade.

Also, during the first reset step cycle, the error detect logic circuit 266 is disabled via an output control gate 306 since, otherwise, an "add" or "+1" signal would generate an "error" signal and thereby operate the error indicator 268 and deactivate the pump.

After the ten BCD decades of the slave storage register 240 are thereby loaded with an 8 BCD count (where the indicator had been at an odd count position and initially indexed in the reverse or subtractive direction) or a 9 BCD count (where the indicator had been at an even count position and initially indexed in the forward or additive direction), the reset cycle sequence switch 290 is stepped to its next step for indexing each of the indicator wheels 60 in the reverse direction to zero. When each indicator wheel 60 reaches "0" (and its one-way locking pawl 136 prevents further reverse rotation of the wheel 60 beyond "0"), a rotation signal will not be generated by the limit comparators 258, 259, and therefore an "add" or "subtract" signal will not be generated by the rotation direction logic circuit 262. A BCD "0" count will thereupon be loaded into the respective BCD decade of the slave storage register 240 via the gate circuit 300 and summation circuit 264. Accordingly, if an indicator wheel 60 reaches "0" before the respective slave storage register decade, its drive coil 98 will be energized during only the following stepping cycle, during which the respective slave storage register decade is reset to "0" and the error detect logic circuit 266 is disabled via the control gate 306 to prevent the generation of an "error" signal. After all of the indicator wheels 60 have been stepped in the reverse direction to "0" and all of the slave storage register decades register are also reset to "0", the initial reset phase of the reset cycle is completed.

A final or indicator check phase of the reset cycle is then initiated to verify that each indicator 58 (a) was in fact reset to "0" and was not inadvertently or improperly retained at another number position, and (b) is properly operating in each angular direction. For that purpose, the reset cycle sequence switch 290 is stepped to a succeeding step to apply "forward" and "non-compare" signals for one full cycle of the sequence switch 330 and then to two succeeding steps to apply "reverse" and "non-compare" signals for two full "reverse check" cycles of the sequence switch 330. Thus, during the indicator check phase of the reset cycle, if operating properly, each indicator wheel 60 would be indexed forwardly one count or step and then rearwardly one count or step back to "0". During the second "0 reverse check" cycle, each indicator should be held against rotation by its respective one-way locking pawl 136 and a rotation signal should not be produced. Therefore, during the second "0 reverse check" stepping cycle, the "step" lead to the RAM 252 is disabled via a gate 296 and any wheel rotation signal will generate an "error" signal to operate the error indicator 268 and deactivate the pump.

After the completion of the final or indicator check phase of the reset cycle, the reset cycle sequence switch 290 is stepped to its "0" or standby step and the pump motor 42 is energized to condition the apparatus for the delivery of fuel.

Although in the indicator system described the pickup coil 99 is employed only for sensing the direction and angular velocity of the number wheel 60, it is contemplated that the pickup coil 99 may also be used in combination with the drive coil 98 (for example, as described in my pending application Ser. No. 706,129) for assisting in indexing the number wheel 60. In that event, although the pickup coil 99 may be energized at the time it is being "read" (depending on the two-coil indexing cycle employed), the voltage differential between the applied voltage $V_R$ and the generated voltage $V_S$ would still provide for determining the direction and angular velocity of the number wheel 60 as in the described embodiment.

As will be apparent to persons skilled in the art, various modifications, adaptations and variations of the foregoing specific disclosure can be made without departing from the teachings of the present invention.

I claim:

1. A fuel pump register for registering a multiple place count of fuel and comprising a bank of indicator decades having a bank of decimal indicator wheels of increasing place respectively for corresponding places respectively of said multiple place count of fuel; each indicator decade having electromagnetic wheel indexing means comprising a salient pole permanent magnet wheel rotor with an annular arrangement of ten equiangularly spaced alternating north and south salient magnetic poles, a salient pole electromagnetic stator cooperable therewith and having a stator core with an annular ring generally coaxial with the rotor and a plurality of angularly spaced salient stator poles adapted to be aligned with each salient pole of the permanent magnet rotor as the rotor is rotated through 360°, first winding means on the stator core adapted to be energized for angularly indexing the respective indicator wheel rotor and therefore the indicator wheel from each of ten decimal count rest indicating positions thereof to the succeeding decimal count rest indicating position, and second winding means on the stator core for sensing rotation of the permanent magnet wheel rotor; and register drive means for selectively energizing the first winding means of each indicator decade for a time interval controlled by the respective second winding means for indexing the bank of indicator wheels for indicating a multiple place count of fuel, the register drive means comprising electronic register means for electronically registering a said multiple place count of fuel, and electrical drive means operable in accordance with the registered count of the electronic register means to selectively energize the first winding means of each indicator decade for selectively angularly indexing the respective indicator wheel from the existing decimal count rest indicating position thereof and operable by the respective second winding means to deenergize the first winding means when the respective indicator wheel is approximately at its succeeding decimal count rest indicating position.

2. A fuel pump register according to claim 1 wherein the electrical drive means comprises a bank of slave decades for the bank of indicator decades respectively, each adapted to be indexed to successive counts thereof in synchronism with the respective indicator decade, electrical indexing means operable for indexing each slave decade when the first winding means of the respective indicator decade is energized for maintaining the respective slave and indicator decades in synchronism, comparator means for comparing the count of each slave decade with the corresponding registered decimal count of the electronic register means, and electrical control means operable by the comparator means when any corresponding decimal counts of the electronic register means and the bank of slave decades are different for energizing each respective first winding means for indexing the respective indicator wheel.

3. A fuel pump register according to claim 1 wherein the electrical drive means comprises first winding control means selectively operable for selectively energizing and deenergizing the first winding means of each indicator decade, energizing control means operable by the electronic register means for selectively operating the first winding control means to selectively energize the first winding means of each indicator decade for angularly indexing the respective indicator wheel from its existing decimal count rest indicating position to the succeeding decimal count rest indicating position, and deenergizing control means operable by the second winding means of each indicator decade for selectively operating the first winding control means to selectively deenergize the respective first winding means when the respective indicator wheel is approximately at its said succeeding decimal count rest indicating position.

4. A fuel pump register according to claim 1 wherein the stator core comprises first and second magnetic circuits in approximately one-half count out of phase relationship, the first magnetic circuit having a first salient pole and at least one additional salient pole angularly spaced therefrom for respective alignment with rotor poles of opposite polarity, the second magnetic circuit having a first pole and a plurality of additional salient poles, with at least one more of said additional poles than in said first magnetic circuit, angularly spaced from the first pole of the second circuit for respective alignment with rotor poles of opposite polarity, the said first winding means being associated with the first magnetic circuit for selectively magnetizing the first magnetic circuit in each direction and the second winding means being associated with the second magnetic circuit for sensing rotation of the indicator wheel rotor therewith.

5. A method of electromagnetically digitally indexing a rotary indicator wheel in one angular direction from each of a plurality of generally equiangularly spaced rest indicating positions thereof to the succeeding rest indicating position in a single step with electromagnetic indexing means adapted to be energized for indexing the indicator wheel by angularly accelerating the indicator wheel from the existing rest indicating position and decelerating the indicator wheel to approximately the succeeding rest indicating position, the method comprising the steps of energizing the electromagnetic wheel indexing means for indexing the indicator wheel in one angular direction from the existing rest indicating position to the succeeding rest indicating position, electromagnetically sensing the rate of rotation of the indicator wheel at least as the indicator wheel is decelerated to approximately the succeeding rest indicating position, and deenergizing the electromagnetic wheel indexing means when the wheel rotation is electromagnetically sensed to be below a predetermined rate.

6. A method of electromagnetically digitally indexing a rotary indicator wheel according to claim 5 wherein the electromagnetic sensing step is initiated after a predetermined interval after the electromagnetic wheel indexing means is energized.

7. A method of electromagnetically digitally indexing a rotary indicator wheel according to claim 5 further comprising the step of electromagnetically sensing the maximum rate of rotation of the indicator wheel at least during a predetermined interval after the electromagnetic wheel indexing means is energized during which the indicator wheel is expected to have its maximum angular rate of rotation; and signalling improper operation if the maximum rate of rotation which is electromagnetically sensed is below a predetermined rate of rotation.

8. A method of electromagnetically digitally indexing a rotary indicator wheel according to claim 5, wherein the rotary indicator wheel is selectively electromagnetically digitally indexed in each angular direction; wherein the electromagnetic indexing means is energized in opposite directions for indexing the rotary indicator wheel in opposite angular directions and in alternate directions from alternate positions of the indicator wheel in each angular direction, and wherein the energizing step comprises energizing the electromagnetic indexing means in a direction in accordance with the existing position of the rotary indicator wheel and a selected angular direction.

9. A method of electromagnetically digitally indexing a rotary indicator wheel according to claim 5 wherein the rotary indicator wheel has an even number of said generally equiangularly spaced rest indicating positions, wherein the electromagnetic indexing means is energized in alternate directions from alternate indicating positions of the indicator wheel in said one angular direction, wherein the electromagnetic sensing step includes sensing the direction of rotation of the indicator wheel, and further comprising the step of checking if the sensed direction of rotation of the indicator wheel is said one angular direction.

10. A method of electromagnetically digitally indexing a rotary indicator wheel according to claim 5 further comprising the step of magnetically detenting the indicator wheel at its succeeding rest indicating position after the electromagnetic wheel means is deenergized.

11. A method of electromagnetically indexing a rotary 0–9 decimal indicator wheel in either angular direction in digital steps from each of a plurality of generally equiangularly spaced 0–9 decimal rest positions thereof to the succeeding decimal rest position with electromagnetic indexing means adapted to be energized for indexing the indicator wheel from the existing decimal rest position to approximately the succeeding decimal rest position, the electromagnetic indexing means being energized in opposite directions for indexing the indicator wheel in opposite angular directions and in alternate directions on alternate indexing steps of the indicator wheel in each angular direction, the method comprising the steps of energizing the electromagnetic wheel indexing means in a selected direction for indexing the indicator wheel in a selected angular direction from the existing decimal rest position to the succeeding decimal rest position, determining the actual direction of rotation through electromagnetically sensing rotation of the indicator wheel above a predetermined minimum rate of rotation while it is being angularly indexed by the wheel indexing means, and electronically comparing the determined actual direction of rotation with the selected angular direction.

12. An indicating system for indicating a count within a multiple place decimal range comprising a bank of decade indicators having a bank of decimal indicator wheels of increasing place respectively for the multiple places respectively of said multiple place decimal range; each decade indicator having electromagnetic wheel indexing means adapted to be energized for angularly indexing the respective indicator wheel from each of ten decimal rest positions thereof to the succeeding decimal rest position, the electromagnetic wheel indexing means being adapted to be energized for angularly accelerating the indicator wheel from said existing decimal rest position and decelerating the indicator wheel to approximately the succeeding decimal rest position, and electromagnetic sensing means for sensing the rate of wheel rotation; electronic register means operable for energizing the electromagnetic wheel indexing means of each decade indicator for angularly indexing the respective indicator wheel from the existing decimal rest position thereof to the succeeding decimal rest position thereof when the existing decimal rest position thereof differs from the respective decimal place of the registered count of the electronic register means, and operable by the electromagnetic sensing means to deenergize the respective electromagnetic wheel indexing means when the respective indicator wheel is approximately at the succeeding decimal rest position.

13. An indicating system according to claim 12 wherein the electrical drive means comprises control means selectively operable for selectively energizing and deenergizing the electromagnetic wheel indexing means of each decade indicator for indexing the respective indicator wheel from the existing decimal rest position to the succeeding decimal rest position, energizing means operable by the electronic register means for selectively operating the control means for selectively energizing each electromagnetic indexing means in a controlled direction for angularly indexing the respective wheel indicator from the existing decimal rest position to the succeeding decimal rest position when the existing decimal rest position thereof differs from the respective decimal place of the registered count of the electronic register means, and deenergizing means operable by the electromagnetic sensing means of each decade indicator for selectively operating the control means for deenergizing the respective electromagnetic wheel indexing means when the respective wheel indicator is approximately at said succeeding decimal rest position.

14. An indicating system according to claim 13 wherein the electrical drive means comprises a bank of electronic slave decades for the bank of decade indicators respectively, electrical indexing means operable for indexing each slave decade one count when the respective electromagnetic wheel indexing means is energized for indexing the respective indicator wheel, and comparator means for comparing each slave decade with the respective decimal place of the registered count of the electronic register means and, when there is any difference therebetween, for operating the control means to energize the respective electromagnetic wheel indexing means for indexing the respective indicator wheel.

15. An indicating system according to claim 14 wherein the electrical indexing means comprises detection means for detecting rotation of each indicator wheel above a predetermined rate with the respective electromagnetic sensing means and for indexing the respective slave decade one count when respective indicator wheel rotation above said predetermined rate is detected.

16. An indicating system according to claim 15 wherein the detection means is operable for detecting the direction of rotation of each indicator wheel with the respective electromagnetic sensing means for indexing the respective slave decade in the corresponding direction.

17. A method of electromagnetically indexing a rotary counter wheel in digital steps in one counting angular direction thereof from each of a plurality of generally equiangularly spaced count positions thereof to the succeeding count position and in the opposite angular direction for resetting the counter wheel to a predetermined reset count position thereof determined by a one-way stop, the rotary counter wheel being digitally indexed in either angular direction in a single step with electromagnetic wheel indexing means adapted to be energized in a direction dependent on the count position of the rotary counter wheel and the direction of rotation, the electromagnetic wheel indexing means being operable for indexing the counter wheel by angularly accelerating the counter wheel from the existing count position and decelerating the counter wheel to approximately the succeeding count position, the method comprising the steps of energizing the electromagnetic wheel indexing means in the direction corresponding to the existing count position of the counter wheel and the desired direction of rotation for indexing the counter wheel to the next desired succeeding count position, electromagnetically sensing the rate of rotation of the counter wheel at least as the counter wheel is decelerating to approximately the succeeding count position, and deenergizing the electromagnetic wheel indexing means when the wheel rotation is electromagnetically sensed to be below a predetermined rate, the method comprising resetting the counter wheel by sequentially digitally indexing the counter wheel in said opposite angular direction to said predetermined reset count position and electromagnetically sensing that the counter wheel has reached said reset count position by sensing wheel rotation below a predetermined rate when the electromagnetic wheel indexing means is subsequently energized to index the wheel one digit step further in said opposite angular direction.

* * * * *